US009849694B2

(12) United States Patent
Brown et al.

(10) Patent No.: US 9,849,694 B2
(45) Date of Patent: Dec. 26, 2017

(54) PRINTER ENCODER ADAPTED FOR POSITIONING ABOARD A MOBILE UNIT

(75) Inventors: Anthony Brown, Spring Grove, IL (US); Boris Y. Tsirline, Glenview, IL (US); Martin Schwan, Chicago, IL (US); Karl Torchalski, Arlington Heights, IL (US); Tom Zwier, Lake Zurich, IL (US); Daniel F. Donato, Johnsburg, IL (US)

(73) Assignee: ZIH Corp., Lincolnshire, IL (US)

( * ) Notice: Subject to any disclaimer, the term of this patent is extended or adjusted under 35 U.S.C. 154(b) by 1334 days.

(21) Appl. No.: 12/963,498

(22) Filed: Dec. 8, 2010

(65) Prior Publication Data

US 2011/0074553 A1 Mar. 31, 2011

Related U.S. Application Data

(63) Continuation of application No. 11/610,452, filed on Dec. 13, 2006, now abandoned.

(60) Provisional application No. 60/750,193, filed on Dec. 13, 2005.

(51) Int. Cl.
*H01Q 1/22* (2006.01)
*B41J 3/44* (2006.01)

(52) U.S. Cl.
CPC ..... *B41J 3/44* (2013.01)

(58) Field of Classification Search
CPC ..... G06K 19/07372; G06K 19/07773; H01Q 1/22; G08B 13/2474; G08B 13/2468
USPC ..... 343/702, 739, 740, 841, 873, 795; 340/10.1, 572.7
See application file for complete search history.

(56) References Cited

U.S. PATENT DOCUMENTS

| | | | |
|---|---|---|---|
| 2,935,747 | A | 5/1960 | Ghose |
| 3,710,340 | A | 1/1973 | Mayes |
| 5,186,558 | A | 2/1993 | Sherman et al. |
| 5,289,378 | A | 2/1994 | Miller et al. |
| 5,314,564 | A | 5/1994 | Kobayashi |
| 5,457,629 | A | 10/1995 | Miller et al. |
| 5,465,207 | A | 11/1995 | Boatwright et al. |
| 5,542,487 | A | 8/1996 | Schultz et al. |
| 5,574,979 | A | 11/1996 | West |
| 5,589,868 | A | 12/1996 | Schofield et al. |
| 5,625,555 | A | 4/1997 | Davis |
| 5,848,848 | A | 12/1998 | St. Jean |
| 5,874,980 | A | 2/1999 | West |
| 5,895,431 | A | 4/1999 | Miller et al. |
| 5,909,233 | A | 6/1999 | Hamman et al. |
| 6,026,378 | A | 2/2000 | Onozaki |

(Continued)

*Primary Examiner* — Dameon E Levi
*Assistant Examiner* — Hasan Islam

(57) ABSTRACT

A printer/encoder system is provided for mounting to a mobile unit, such as a forklift-type vehicle. The printer/encoder system is adapted for printing and encoding one or more media units that may be stored in a media supply assembly of the printer/encoder system. The printer/encoder system may be mounted to the mobile unit using a mobile unit mounting assembly having a shock resistance system for protecting at least portions of the printer/encoder system from mechanical shocks or vibrations that are commonly associated with mobile unit movement. The printer/encoder system may include an encoder assembly structured to encode a transponder, such as a radio frequency identification (RFID) transponder, on a media unit. The printer/encoder system may include an encoder assembly having a modular design.

9 Claims, 11 Drawing Sheets

(56) References Cited

U.S. PATENT DOCUMENTS

| | | | | |
|---|---|---|---|---|
| 6,057,870 | A | 5/2000 | Monnier et al. | |
| 6,068,415 | A | 5/2000 | Smolenski | |
| 6,091,374 | A | 7/2000 | Barnes | |
| 6,147,767 | A | 11/2000 | Petteruti et al. | |
| 6,151,037 | A | 11/2000 | Kaufman et al. | |
| 6,323,821 | B1 | 11/2001 | McLean | |
| 6,327,972 | B2 | 12/2001 | Heredia et al. | |
| 6,364,550 | B1 | 4/2002 | Petteruti | |
| 6,409,401 | B1 | 6/2002 | Petteruti et al. | |
| 6,421,018 | B1 * | 7/2002 | Zeilinger et al. | 343/713 |
| 6,424,309 | B1 | 7/2002 | Johnston et al. | |
| 6,481,907 | B2 | 11/2002 | Banach et al. | |
| 6,583,803 | B2 | 6/2003 | Poole et al. | |
| 6,669,089 | B2 | 12/2003 | Cybulski et al. | |
| RE38,473 | E | 3/2004 | Smolenski | |
| 6,806,812 | B1 * | 10/2004 | Cathey | 340/572.7 |
| 6,869,019 | B1 | 3/2005 | Nagi et al. | |
| 7,017,808 | B2 * | 3/2006 | Holzer | 235/385 |
| 7,025,268 | B2 | 4/2006 | Alleshouse | |
| 7,059,518 | B2 * | 6/2006 | Forster | 235/385 |
| 7,098,794 | B2 * | 8/2006 | Lindsay et al. | 340/572.3 |
| 7,154,442 | B2 * | 12/2006 | van Wonterghem et al. | 343/702 |
| 7,228,433 | B2 | 6/2007 | Turner et al. | |
| 7,236,851 | B2 * | 6/2007 | Charych | 700/214 |
| 7,245,312 | B2 | 7/2007 | Smolenski et al. | |
| 7,250,845 | B2 * | 7/2007 | Young et al. | 340/5.92 |
| 7,358,918 | B2 * | 4/2008 | Itsuji | 343/772 |
| 7,398,054 | B2 | 7/2008 | Tsirline et al. | |
| 7,398,926 | B1 * | 7/2008 | Kikin et al. | 235/451 |
| 7,407,102 | B2 | 8/2008 | Alleshouse | |
| 7,425,887 | B2 | 9/2008 | Tsirline et al. | |
| 7,498,942 | B2 | 3/2009 | Torchalski et al. | |
| 7,504,950 | B2 | 3/2009 | Torchalski | |
| 7,551,140 | B2 * | 6/2009 | Knadle et al. | 343/700 MS |
| 2002/0130778 | A1 * | 9/2002 | Nicholson | 340/572.1 |
| 2002/0147597 | A1 | 10/2002 | Connors et al. | |
| 2002/0163662 | A1 | 11/2002 | Kaufman et al. | |
| 2003/0112187 | A1 * | 6/2003 | Whitehouse | 343/702 |
| 2003/0201697 | A1 | 10/2003 | Richardson | |
| 2004/0236707 | A1 | 11/2004 | Lingdell | |
| 2005/0035198 | A1 | 2/2005 | Wilensky | |
| 2005/0084315 | A1 | 4/2005 | Lodwig et al. | |
| 2005/0168340 | A1 * | 8/2005 | Mosher et al. | 340/572.8 |
| 2005/0206524 | A1 | 9/2005 | Forster et al. | |
| 2005/0210610 | A1 | 9/2005 | Louie et al. | |
| 2005/0231365 | A1 * | 10/2005 | Tester et al. | 340/568.1 |
| 2006/0020803 | A1 | 1/2006 | O'Hagan | |
| 2006/0049253 | A1 | 3/2006 | Butler | |
| 2006/0132312 | A1 * | 6/2006 | Tavormina | 340/572.7 |
| 2006/0164447 | A1 | 7/2006 | Poole et al. | |
| 2006/0171755 | A1 | 8/2006 | Clarke | |
| 2006/0221167 | A1 | 10/2006 | Maynard et al. | |
| 2006/0249566 | A1 | 11/2006 | Alleshouse | |
| 2006/0251461 | A1 | 11/2006 | Lodwig et al. | |
| 2007/0023068 | A1 | 2/2007 | Helma | |
| 2007/0031617 | A1 | 2/2007 | Field | |
| 2007/0081842 | A1 | 4/2007 | Ehrhardt, Jr. | |
| 2007/0099462 | A1 | 5/2007 | Helma et al. | |
| 2007/0125859 | A1 | 6/2007 | Alleshouse | |
| 2007/0126558 | A1 | 6/2007 | Donato | |
| 2007/0147938 | A1 | 6/2007 | Brown et al. | |
| 2007/0216591 | A1 | 9/2007 | Tsirline et al. | |
| 2008/0030771 | A1 | 2/2008 | Alleshouse | |
| 2008/0117027 | A1 | 5/2008 | Tsirline et al. | |
| 2008/0238606 | A1 | 10/2008 | Tsirline et al. | |

* cited by examiner

PRINTER ENCODER ADAPTED FOR POSITIONING ABOARD A MOBILE UNIT

CROSS-REFERENCE TO RELATED APPLICATIONS

This application is a continuation of U.S. patent application Ser. No. 11/610,452, filed Dec. 13, 2006, now abandoned which claims the benefit of U.S. Provisional Patent Application No. 60/750,193, filed Dec. 13, 2005, each of which is incorporated by reference in its entirety.

BACKGROUND OF THE INVENTION

Field of the Invention

The present invention relates generally to a mobile printing and encoding system. More specifically, the present invention relates to a printer and associated RF ("radio frequency") encoder that is structured and adapted for positioning aboard a mobile unit such as a forklift.

Description of the Related Art

FIG. 1 depicts a forklift 300 adapted for interrogatting radio frequency identification ("RFID") transponder equipped articles (not shown) in accordance with the known prior art. The depicted forklift 300 includes a plurality of radio frequency ("RF") antennas 330 attached to a lifting device 310 of the forklift and are directed toward a loading area 320 of the forklift 300 for interrogating RFID transponder equipped articles that may be lifted or otherwise manipulated by the lifting device 310. As will be apparent to one of ordinary skill in the art, RFID transponders that are commonly attached to inventory articles have a memory that may contain identification information, article destination information, tracking information, shipping information, billing information, article ownership information, etc. When the forklift 300 picks up an RFID transponder equipped article, or pallet of articles, using its lifting device 330, an RFID reader (not shown) engages the RF antennas 330 to read any RFID transponders disposed in interrogating proximity to the lifting device 310. Any information retrieved by the RFID reader may be displayed on user interface 340 disposed in a passenger accessible area 325 aboard the forklift 300 as shown.

BRIEF SUMMARY OF THE INVENTION

In one embodiment of the present invention, a printer/encoder system is provided and is adapted to be mounted to a mobile unit, such as a forklift-type vehicle. The mobile unit may have a loading area and a passenger accessible area and the printer/encoder system may be mounted proximate to the passenger accessible area. The printer/encoder system is adapted for printing and encoding one or more media units. For example, the printer/encoder system may include an encoder antenna assembly for transmitting electromagnetic energy in order to encode (e.g., read and/or write) a radio frequency transponder associated with the one or more media units.

In one embodiment, the printer/encoder system includes a mobile unit mounting system for mounting the printer/encoder system to a mobile unit. The mobile unit mounting system may include a shock resistance system for protecting at least a portion of the printer/encoder system from mechanical shocks or vibrations that are commonly associated with mobile unit movement.

The printer/encoder system may include an encoder antenna assembly configured to concentrate electromagnetic energy on a first media unit or a particular portion of a first media unit in an interrogation region of the printer/encoder system. The encoder antenna assembly may be further configured to shield the electromagnetic energy from other media units proximate the first media unit. The printer/encoder system may further include a modular configuration of the encoder assembly that is adapted to allow for easy replacement of encoder components with new or different components, such as different encoder antenna assemblies adapted for different types of media units.

BRIEF DESCRIPTION OF THE SEVERAL VIEWS OF THE DRAWINGS

Figure 1:
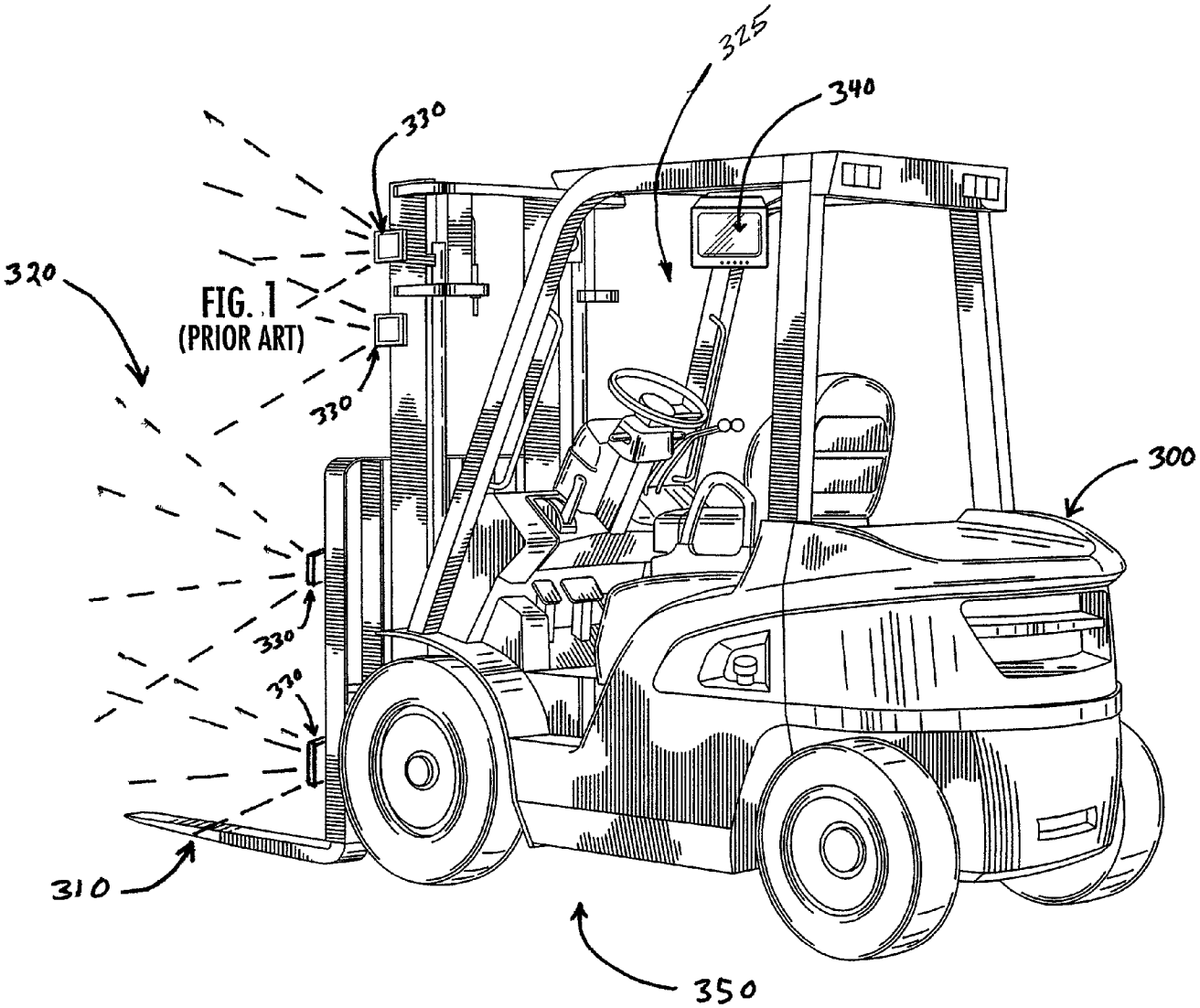
FIG. 1 (PRIOR ART)
Figure 2:
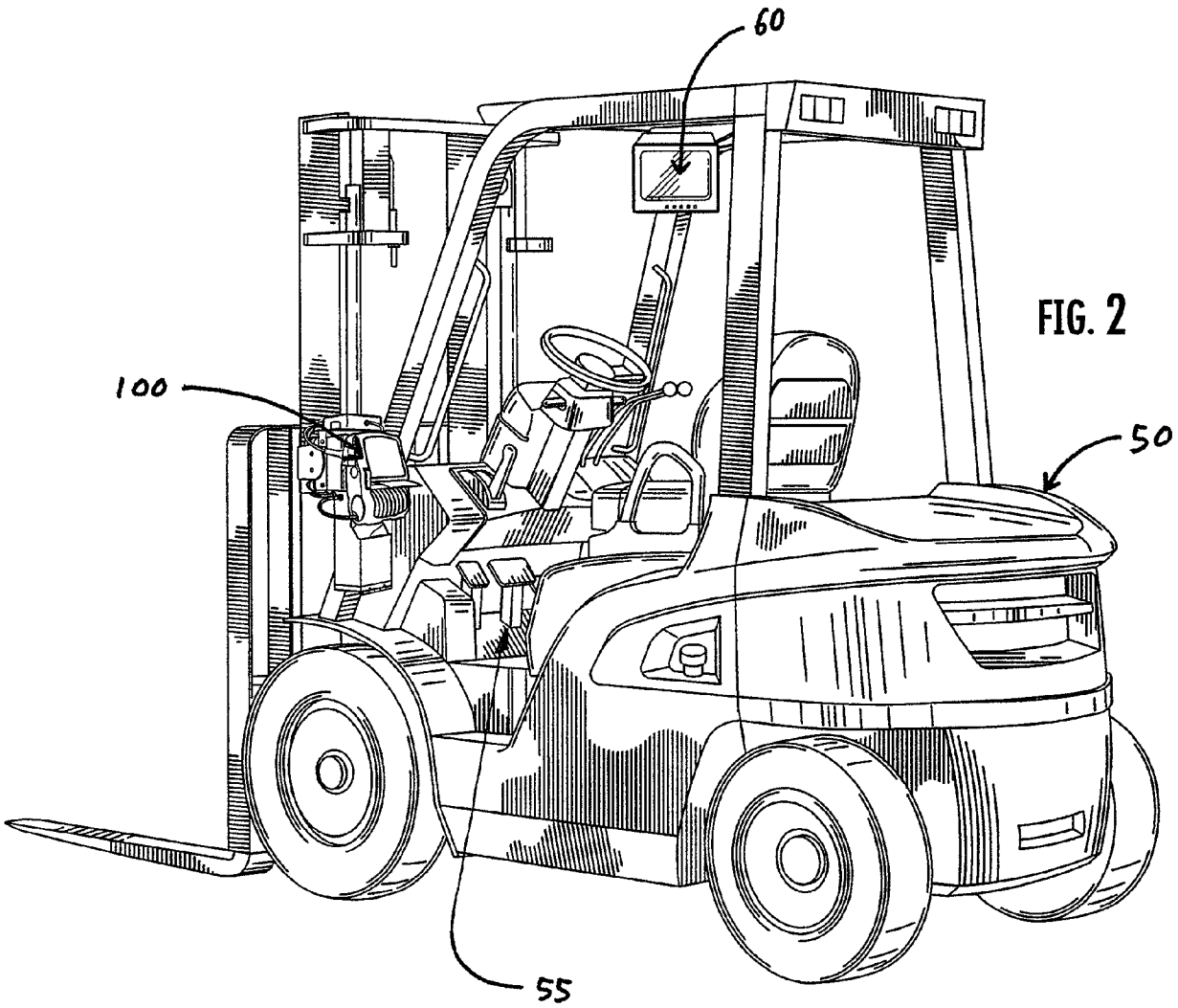
Figure 3:
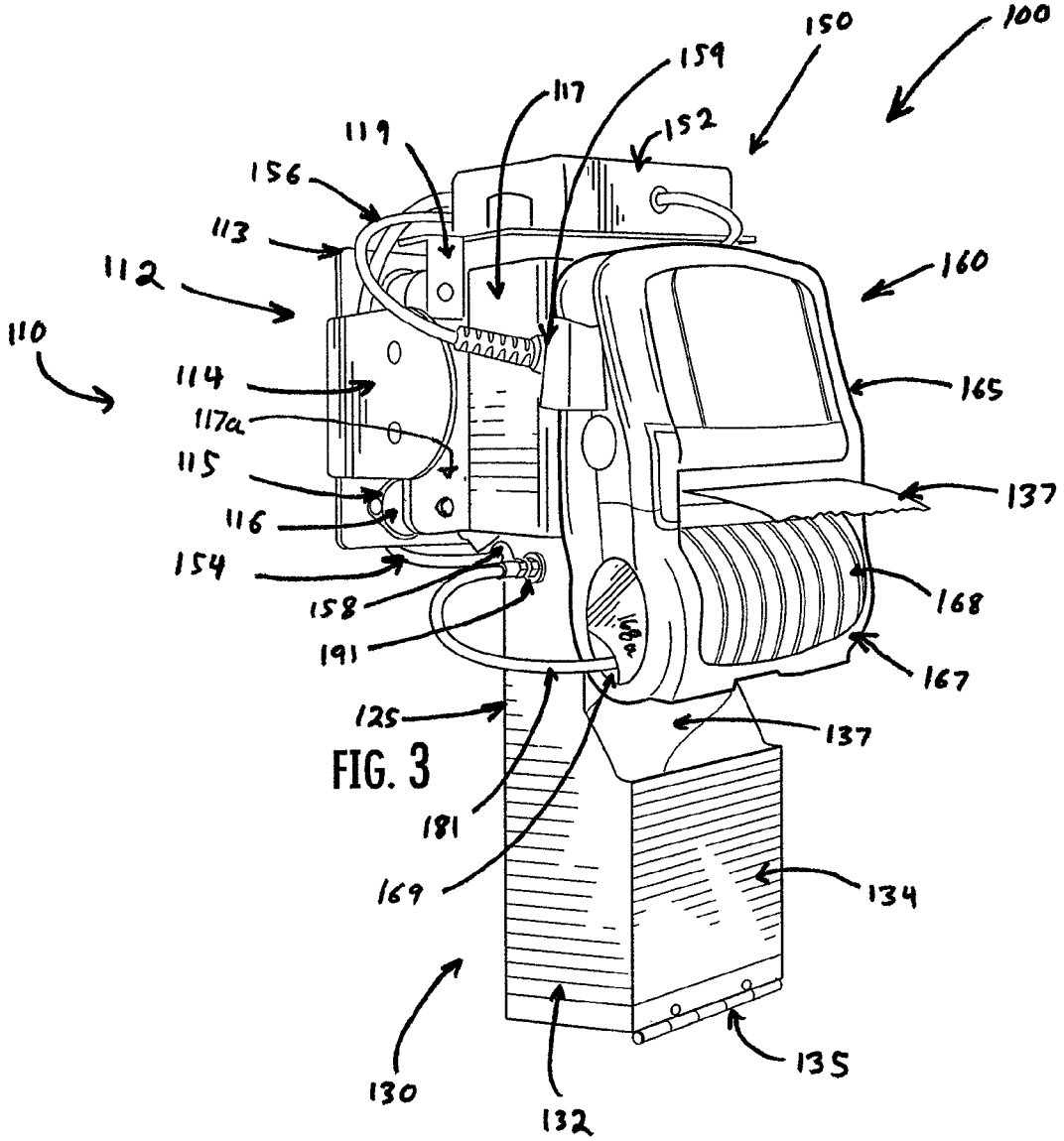
Figure 4:
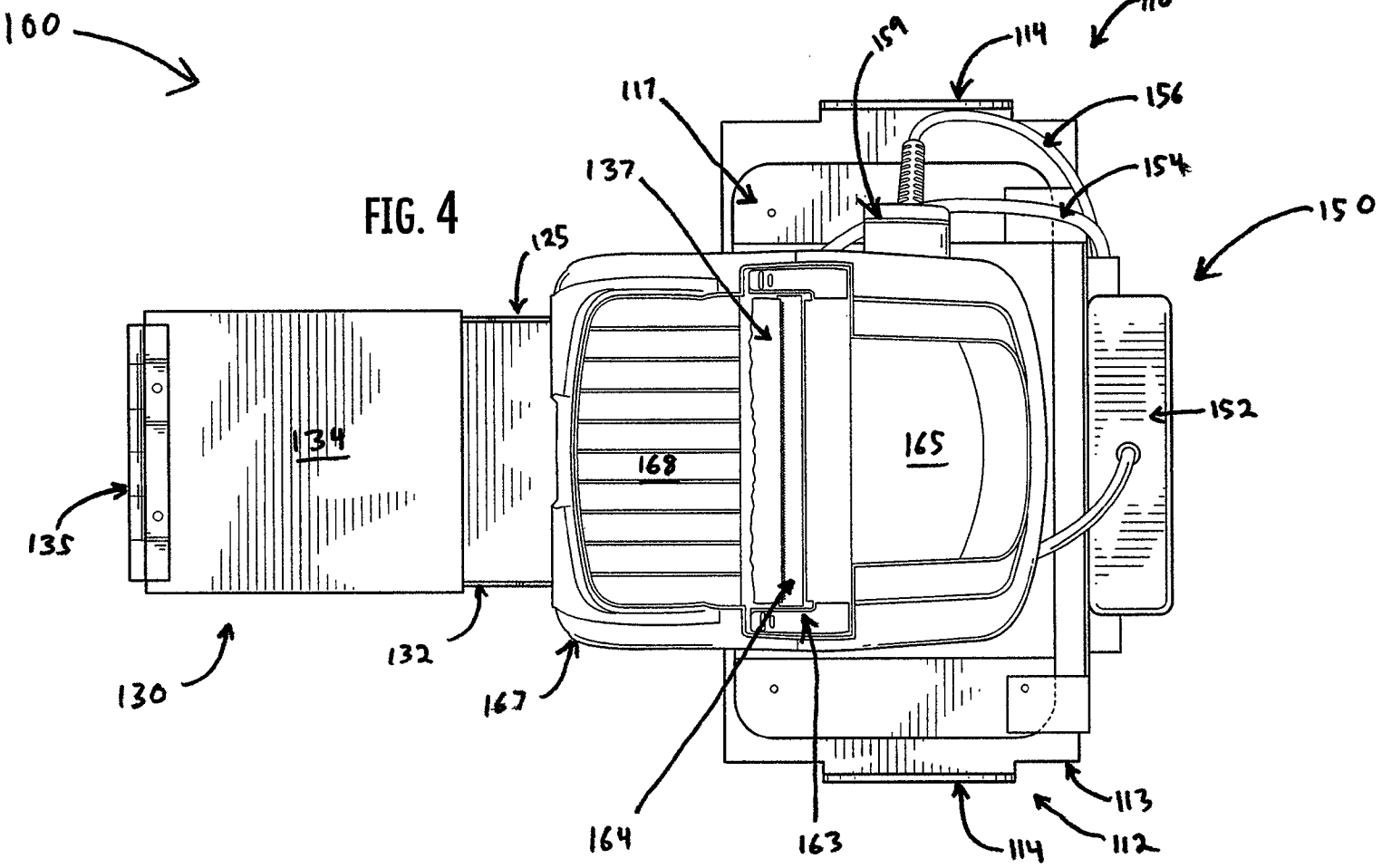
Figure 5:
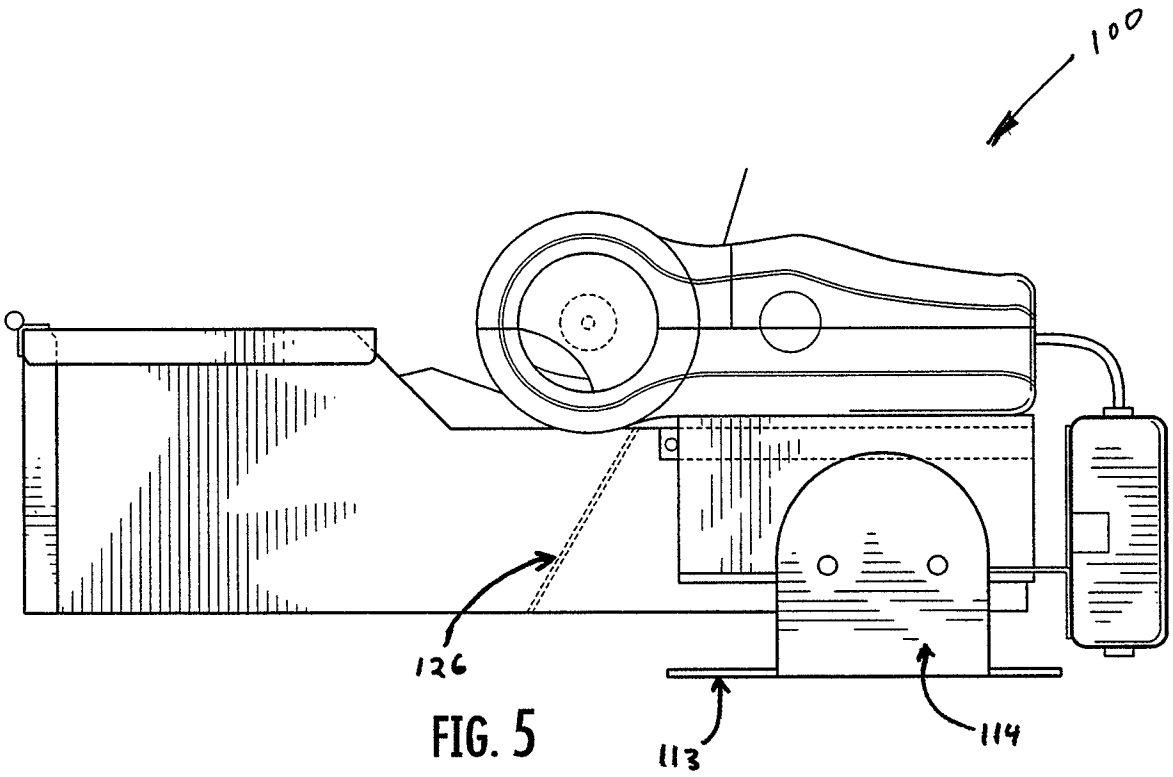
Figure 6:
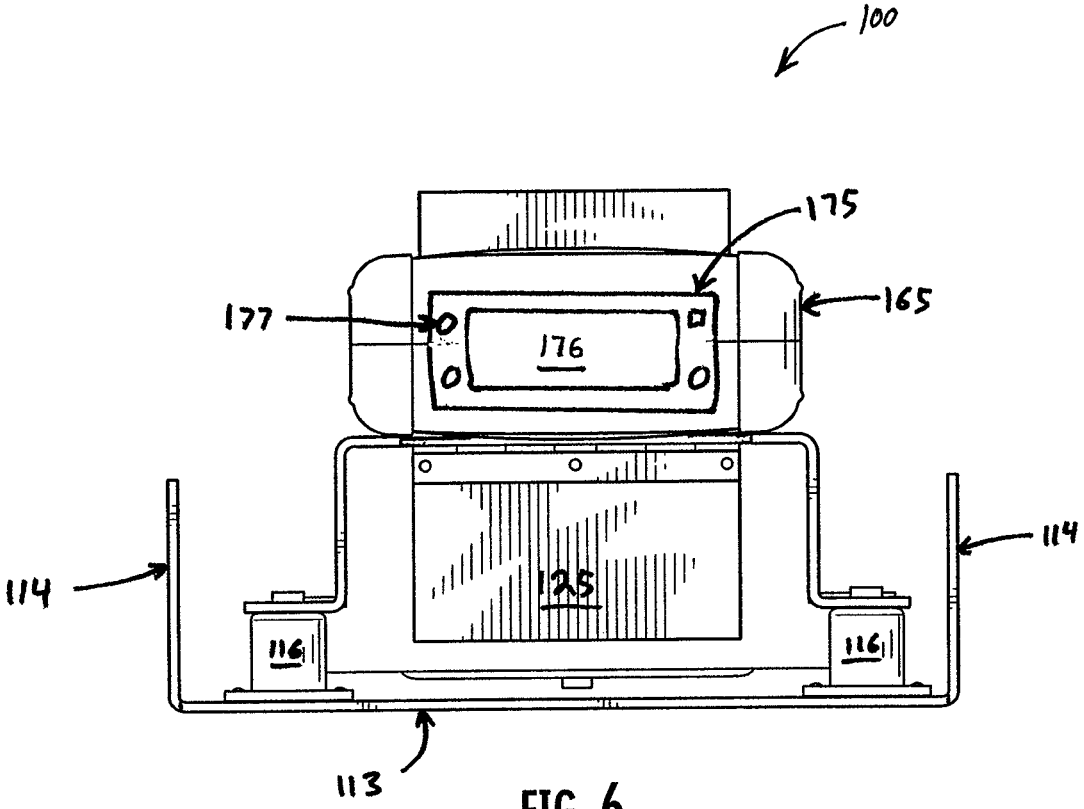
Figure 7:
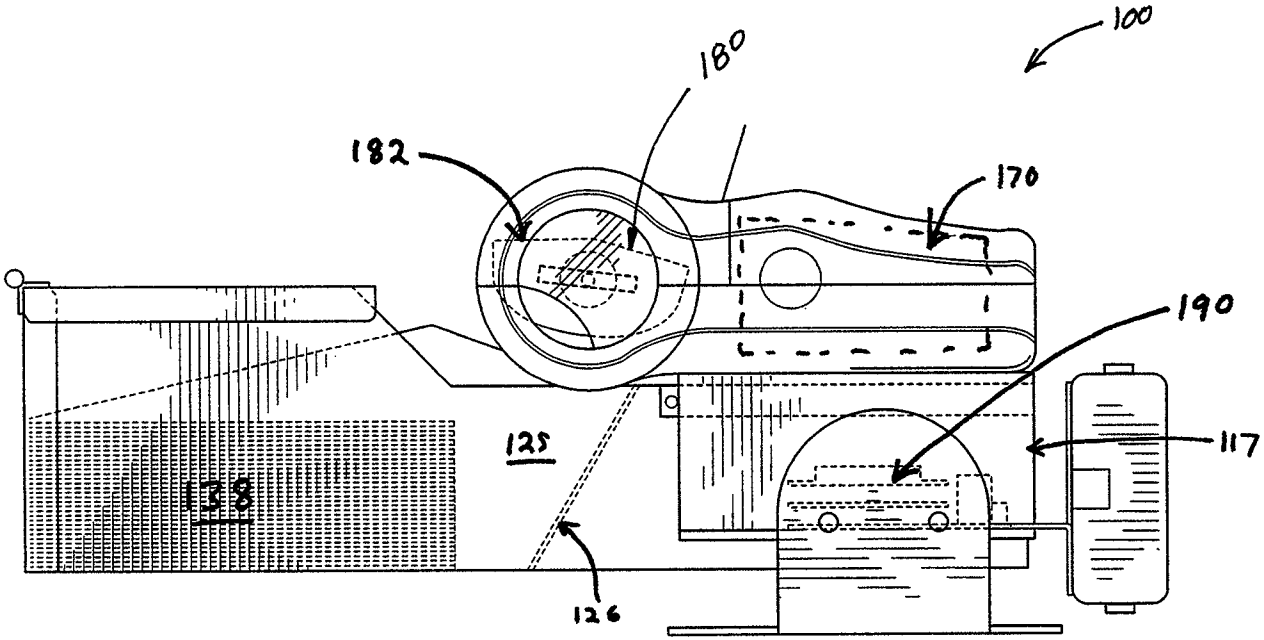
Figure 8:
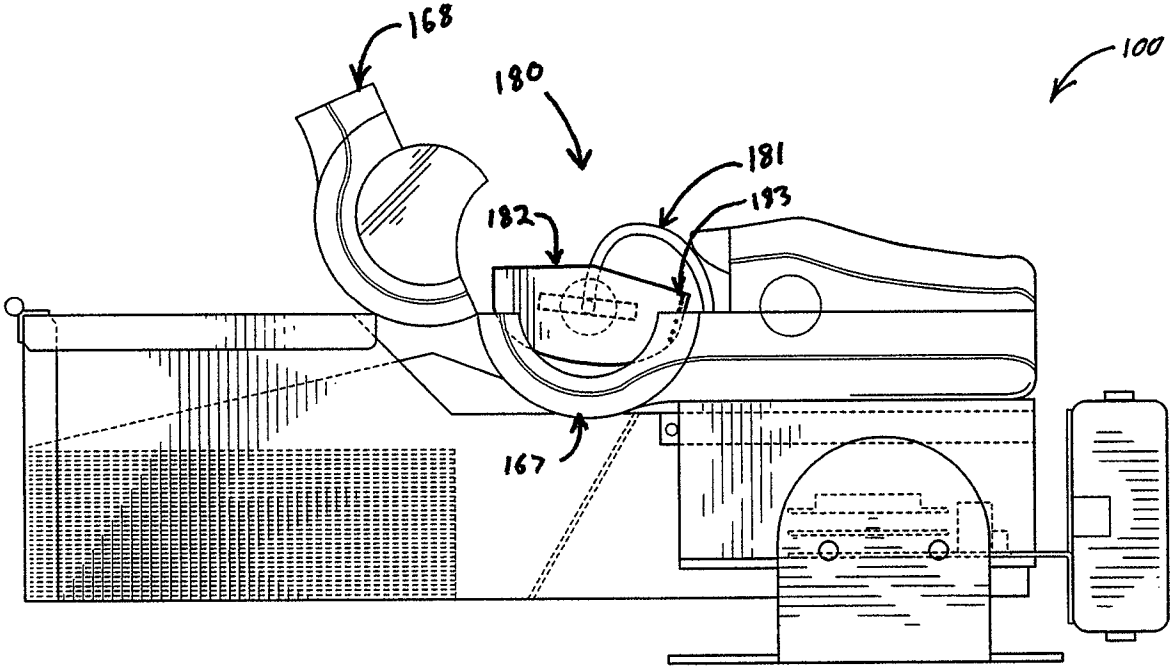
Figure 9:
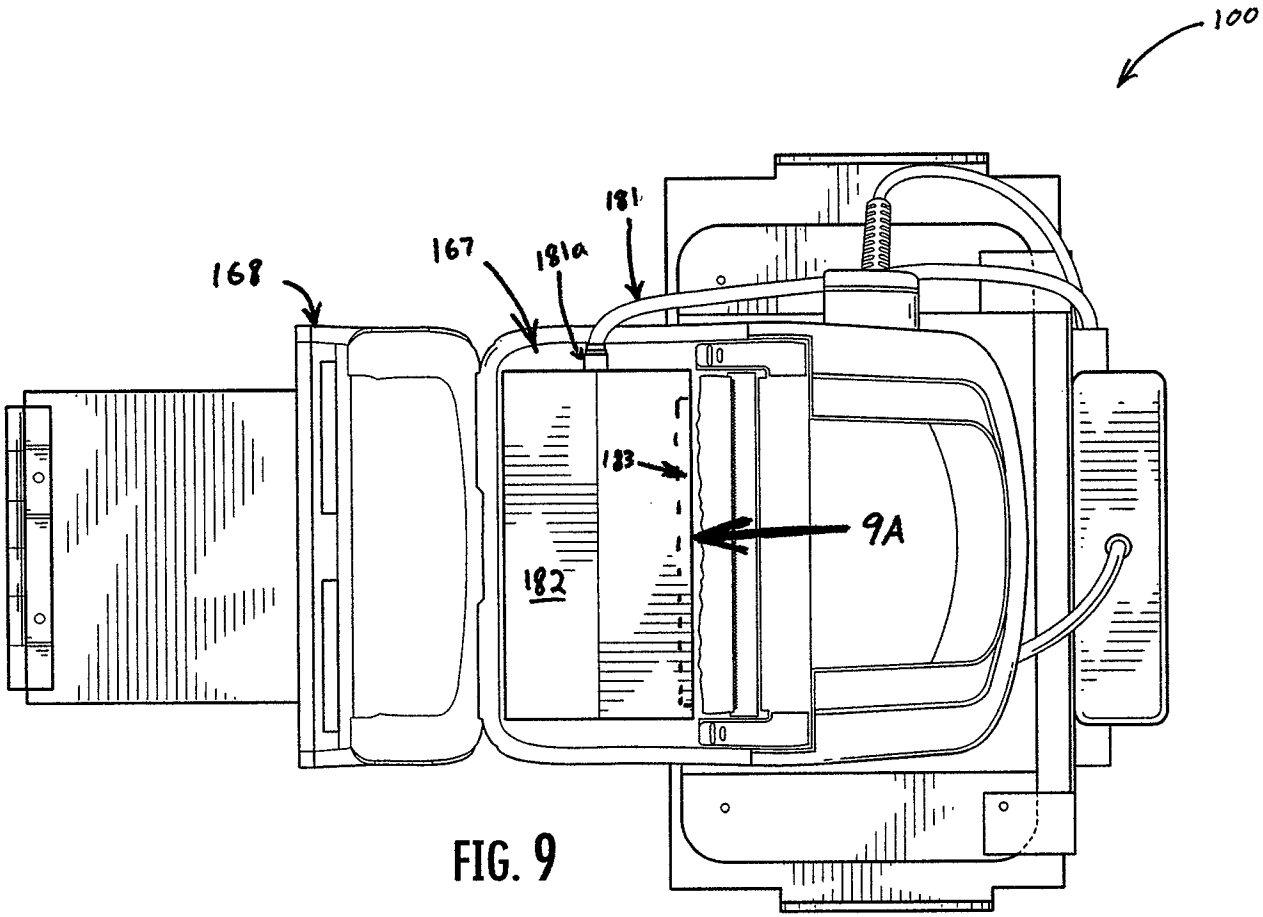
Figure 9A:
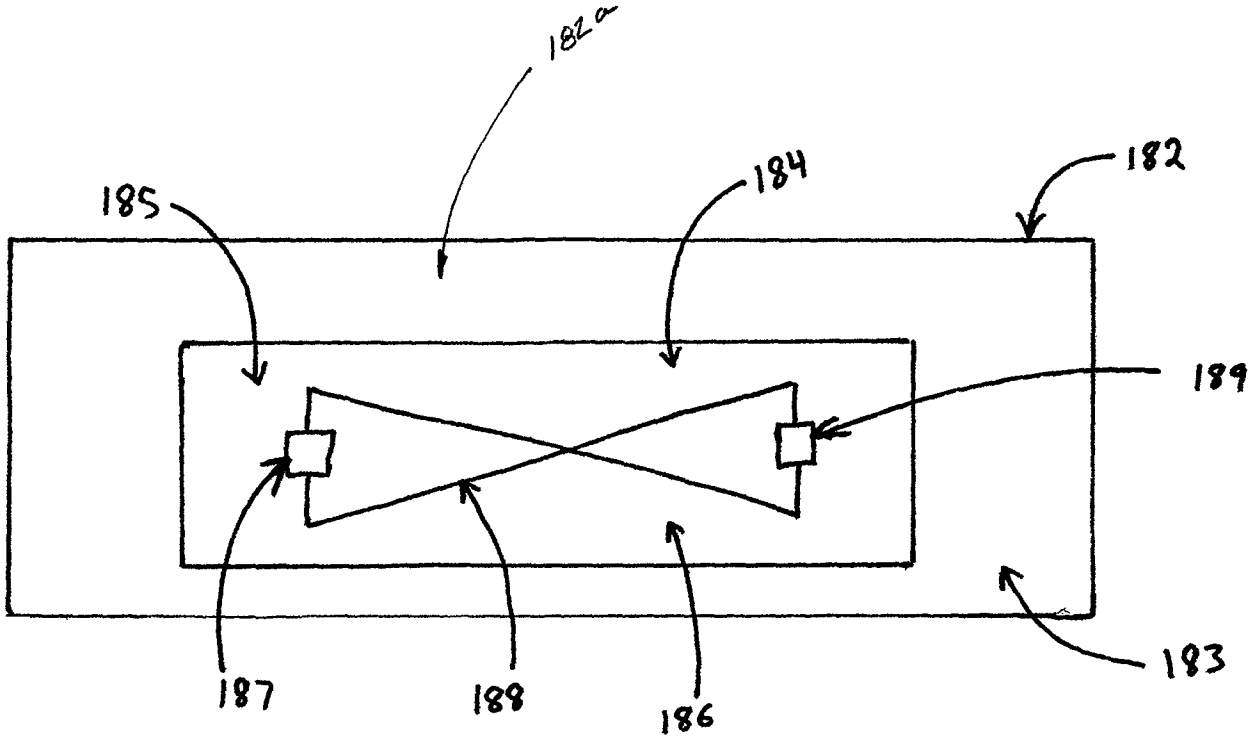
Figure 10:
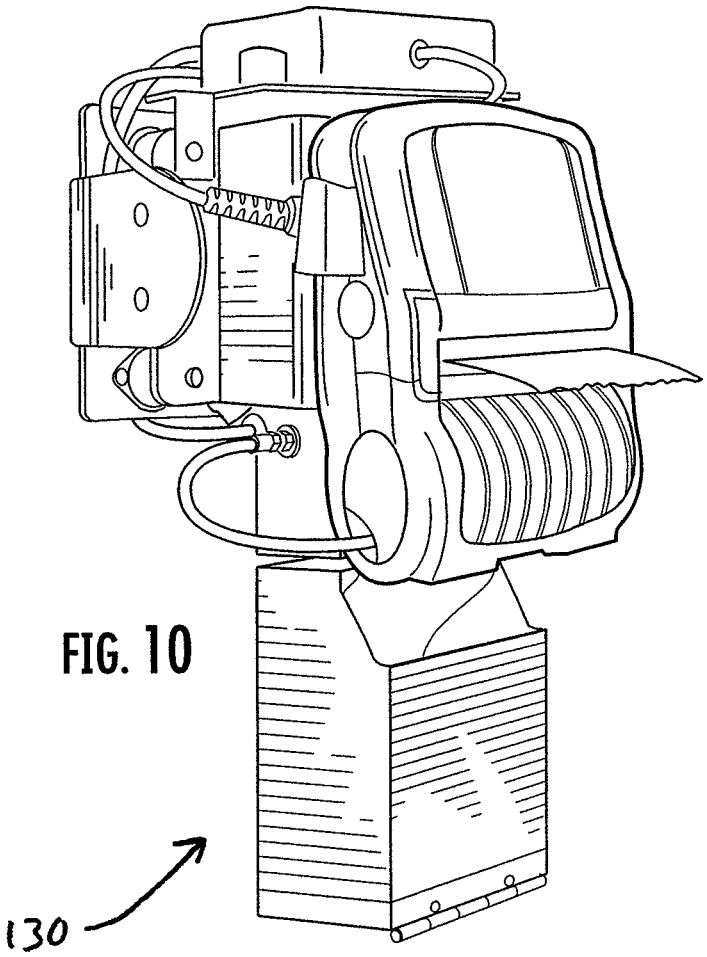

Having thus described the invention in general terms, reference will now be made to the accompanying drawings, which are not necessarily drawn to scale, and wherein:

FIG. 1 is a perspective view of a forklift having an RFID antenna disposed in interrogating proximity to its lifting device in accordance with the known prior art;

FIG. 2 is a perspective view of a printer/encoder system installed on an exemplary mobile unit consistent with one embodiment of the present invention;

FIG. 3 is a perspective view of a printer/encoder system consistent with one embodiment of the present invention;

FIG. 4 is a top view of a printer/encoder system consistent with one embodiment of the present invention;

FIG. 5 is a side view of a printer/encoder system consistent with one embodiment of the present invention;

FIG. 6 is a front view of a printer/encoder system consistent with one embodiment of the present invention;

FIG. 7 is a side view of a printer/encoder system depicting selected hidden components of the media supply system, the encoder electronics system, and the antenna system consistent with one embodiment of the present invention;

FIG. 8 is a side view of a printer/encoder system with the antenna housing door in an open configuration for depicting components of the antenna system consistent with one embodiment of the present invention;

FIG. 9 is a top view of a printer/encoder system with the antenna housing door in the open configuration to better illustrate selected components of the antenna system consistent with one embodiment of the present invention;

FIG. 9A is a detail view of an exemplary antenna structure provided as part of the antenna system of the printer/encoder system shown in FIG. 9, wherein the detail view of FIG. 9A is taken from the perspective of arrow 9A of FIG. 9; and FIG. 10 is a perspective view of a printer/encoder system wherein the media storage bin is detached from the other systems of the printer/encoder consistent with one embodiment of the present invention.

DETAILED DESCRIPTION OF THE INVENTION

The present invention will now be described more fully hereinafter with reference to the accompanying drawings, in which some, but not all embodiments of the inventions are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

FIG. 2 depicts a printer/encoder system 100 attached to a mobile unit 50 for printing and encoding media units in accordance with one embodiment of the present invention. For purposes of the foregoing specification and appended claims the term "mobile unit" refers to a truck, cart, or other vehicle that is adapted for inventory control and/or inventory management operations. The foregoing descriptions and associated figures describe an exemplary mobile unit, namely, a forklift type vehicle. Such figures and descriptions are provided merely for illustration purposes and should not be construed as necessarily limiting unless specifically claimed as such.

The printer/encoder system 100 illustrated in FIG. 2 is located in a passenger accessible area 55 of the mobile unit 50 in accordance with one embodiment of the present invention. In this regard, the depicted printer/encoder system 100 is conveniently accessed by an operator. Notably, the depicted positioning differs from prior art RFID transponder equipped mobile unit configurations such as that shown in FIG. 1 wherein all RF antenna structures 330 are disposed in readable proximity to the loading area 320 of the mobile unit.

Printer/encoder systems 100, such as that illustrated in FIG. 2, may, in some embodiments, be configured to communicate with a user interface 60 that is generally mounted in the passenger accessible area 55 of the mobile unit 50. In various embodiments, for example, the user interface 60 may be used to display information about the printer/encoder system, the media, or information to be printed or encoded on media units that are attachable to an inventory article. The user interface 60 may also be interactive and enable the user to send commands to the printer/encoder system 100.

FIG. 3 illustrates a printer/encoder system 100 structured in accordance with another embodiment of the present invention. For purposes of the foregoing specification and appended claims the term encoder refers to a device adapted to transmit electromagnetic energy into an interrogation zone and thereby read and/or write information to one or more RFID transponders located within the interrogation zone. The foregoing descriptions and associated figures describe an exemplary printer/encoder system. Such figures and descriptions are provided merely for illustration purposes and should not be construed as limiting.

Printer/encoder systems in accordance with various embodiments of the present invention are mounted within a passenger accessible area of a mobile unit such as a forklift and are adapted to print visual indicia to one or more media units, read electronic information possibly provided within transponders disposed on or within the media units, and write electronic information to such transponders. In this regard, the printer/encoder system 100 depicted in FIG. 3 includes a printer/encoder assembly 160, a bracket assembly 110 for supporting the printer/encoder assembly 160 and attaching the printer/encoder assembly 160 to the mobile unit (not shown), a media supply assembly 130 for storing media units, and a power supply assembly 150 for providing power to the printer/encoder assembly 160.

In the depicted embodiment, the bracket assembly 110 comprises a mobile unit mounting system 112, a shock resistance system 115, a power supply mounting system 119, and a printer/encoder mounting system 117. The depicted mobile unit mounting system 112 includes base 113 and side brackets 114. The base 113 and the side brackets 114 may be adapted to receive one or more fasteners (not shown) and used, alone or in combination, for mounting the printer/encoder system 100 to the mobile unit.

The depicted shock resistance system 115 is attached to the base 113 and provides a structure for protecting the printer/encoder system 100 from mechanical shocks or vibrations that are commonly associated with mobile unit movement. The shock resistance system may be comprised of springs, rubber mounts, pneumatics, or any other device known in the art for absorbing, dissipating, or reducing the transfer of vibrations and/or forces from one body to another. FIG. 3 depicts a shock resistance system 115 having four shock mounts 116 that are used to connect the four corners of the printer/encoder mounting system 117 to the base 113. Notably, only two of the four shock mounts 116 are visible in FIG. 3.

FIG. 3 depicts an inverted C-shaped bracket as the printer/encoder mounting system 117 in accordance with one embodiment of the present invention. The depicted printer/encoder mounting system 117 includes a first flange 117*a* and a second flange (not shown) defining apertures for receiving fasteners for attaching the printer/encoder mounting system 117 to the shock mounts 116 and base 113.

The depicted power supply mounting system 119 is comprised of a bracket connected to the printer/encoder mounting system 117. As will be apparent to one of ordinary skill in the art, the inventive concepts of the present invention are not limited to the specific bracket assembly 110 depicted in FIG. 3. For example, in one alternative embodiment, the power supply mounting system may be mounted to the base rather than the printer/encoder mounting system as shown. In fact, a variety of mounting structures, brackets, and assemblies of differing material compositions (e.g., polymers, metals, composites, and combinations thereof) may be apparent to one of ordinary skill in the art based upon the mounting area/structures available in the passenger accessible area of the mobile unit. Further, the precise structure (e.g., size, weight, shape, etc.) of the printer/encoder 160 will also play a significant role in selecting the structure and composition of a specific bracket assembly.

FIG. 3 further depicts a media supply assembly 130 consistent with one embodiment of the present invention. As depicted, the media supply assembly 130 comprises a media storage bin 132 structured for holding one or more media units 137 comprising a substrate for receiving printed indicia and one or more RFID transponders. For purposes of the present specification and appended claims the term "media unit" shall refer to all types of media that are attachable to an article including lined and linerless labels, tickets, cards, tapes, and other similar materials.

The depicted media storage bin 132 includes a hinged media access panel 134. In this regard, the media access panel 134 opens to allow access to the interior of the media storage bin 132 for loading, changing, viewing, or otherwise accessing the media units 137 contained therein. In other embodiments, the media storage bin 132 may define a cylindrical housing or alternatively, may not define a housing at all and be simply comprised of a spindle for supporting an exposed roll of media units. Notably, the depicted media storage bin 132 is extended to define an integral housing 125 that attaches to the bracket assembly 110 as shown or alternatively, may be provided as a separate unit as described in greater detail with regard to FIG. 10 below. In the depicted embodiment, the generally rectangular housing 125 is connected to the underside of the C-shaped bracket 117 and thereby obtains the benefit of the shock resistance system 115. The media supply assembly 130 may be comprised of a variety of materials including metals, polymers, composites, and combinations thereof as will be apparent to one of ordinary skill in the art.

As noted above, the media supply assembly 130 is adapted to store, protect, and feed media units 137 to the printer/encoder. The depicted media units 137 are a strip of adhesively backed labels having one or more RFID transponders embedded in each label. The labels are provided on a carrier strip that is folded into a fanfold structure (shown as 138 in FIG. 7) and placed in the media storage bin 132. The carrier strip is fed between the platen and the printhead of the printer/encoder such that the labels may be may continually drawn from the media supply bin 132 and printed as will be apparent to one of ordinary skill in the art. In alternative embodiments, the media units may be stored in roll form of fed via one or more media feeding/handling devices that are commonly known in the art. For example, if the media 137 is a media supply roll, the media storage bin may be comprised of a cylindrical housing or even just a spindle for holding a media unit supply roll.

FIG. 3 also depicts a power supply system 150 in accordance with one embodiment of the present invention. The depicted power supply system 150 is comprised of a power source 152 and power cables 154 and 156. In the depicted embodiment, the power source 152 is a combination battery and battery charger and is mounted to the power supply mounting system 119. Alternatively, the power source 152 may comprise a battery alone or a power adapter for connecting to a mobile unit power source (not shown) or an AC power source. Power cables 154 and 156 are used to carry power from the power source 152 to the printer/encoder system 160. In one embodiment, a single power cable (not shown) may carry all the power necessary for the printer/encoder system 160. In another embodiment, two power cables 154 and 156 may individually connect the power supply system 150 to the encoder electronics assembly (shown as 190 in FIG. 7) and the printer assembly 170, respectively. This feature may have a benefit of making it easy to detach the power cords when replacing or servicing various components of the printer/encoder system 100.

FIG. 3 further depicts a printer/encoder assembly 160 in accordance with one embodiment of the present invention. The depicted printer/encoder assembly 160 includes a printer assembly (shown as 170 in FIG. 7) comprising a printhead and a platen roller, an encoder antenna assembly (shown as 180 of FIG. 8), and an encoder electronics assembly (shown as 190 of FIG. 7). The depicted printer/encoder assembly 160 includes a shell or housing 165 for enclosing and protecting various components including the printer assembly, printer electronics, and the like. A variety of known printing systems may be used to print human or machine readable indicia to the media unit substrate. For example, thermal transfer, direct thermal, ink jet, and laser printing systems may be used. Such print systems are well-known in the art and thus are not described in detail here.

The shell or housing 165 may take many different configurations without departing from the inventive concepts of the present invention. Preferably, the shell 165 is made of a durable material, such as metal, rubber, polymers, composites, or combinations thereof, for protecting the printer/encoder system components in a warehouse, factory, office, or other similar environment. In various embodiments, the shell 165 may comprise removable or hinged access panels such that one or more of the systems contained within the shell 165 are accessible by a user.

In the depicted embodiment, the shell 165 includes an antenna housing portion 167 for enclosing the encoder antenna assembly (180 of FIG. 8). The depicted antenna housing portion 167 includes a removable access panel **168*a* for providing access to the encoder antenna assembly as will be apparent to one of ordinary skill in the art. In the depicted embodiment, a cable access hole 169 is defined in the access panel 168*a* for accommodating a cable 181 that electrically connects the encoder antenna assembly (180 of FIG. 8) with the encoder electronics assembly (190 of FIG. 7**).

FIG. 4 is a top view of the printer/encoder system 100 of FIG. 3 consistent with one embodiment of the present invention. FIG. 4 is shown in order to provide a person skilled in the art with a better understanding of the structure of one embodiment of the invention. Notably, FIG. 4 illustrates a media exit region 163 defined in the shell 165 of the printer/encoder assembly 160 through which media units 137 exit after printing and/or reading and/or encoding. In other embodiments, the printer/encoder system 100 may further comprise a tear bar 164 or other media detachment system (not shown) for cutting, bursting, or tearing or otherwise separating one or more media units from the remaining media units of the continuous media strip, roll, stack, or ribbon. In other embodiments, a tear bar or media detachment system may not be necessary or even desired depending on the type of media used. For example, such a system may be unnecessary if the media units consist of individual cards or if the strip of media supply had perforations between each label for aiding in separating portions of media without the use of other devices.

FIG. 5 is a side view of the printer/encoder system 100 embodiment shown in FIGS. 3 and 4. FIG. 5 is provided in order to illustrate an alternative view of the structure of various selected components of the depicted printer/encoder system 100. Various components that were shown in FIG. 3 have been omitted for simplicity, for example, the shock mounts (116 of FIGS. 3, 6, and 10) have been omitted so that one may observe the structure of the depicted bracket assembly embodiment. Notably, in the depicted embodiment, a housing divider 126 is provided within the housing 125 for separating the media supply portion of the housing 130 from the portion of the housing that is to containing the encoder electrical assembly (190 of FIG. 7).

FIG. 6 is a front view of the printer/encoder system 100 depicted in FIGS. 3, 4, and 5. FIG. 6 is shown in order to provide a person skilled in the art with a better understanding of this one embodiment of the invention. Thus, FIG. 6 is for illustration purposes and should not be construed as limiting. Besides showing front views of many of the systems and assemblies described above, FIG. 6 further illustrates a user interface 175 for the printer/encoder system provided a front portion of the shell 165 in accordance with one embodiment of the invention. As depicted by FIG. 6, the user interface 175 may comprise a display 176, such as a liquid crystal display (LCD), and may further comprise at least one key or button 177 for enabling a user to input information and/or engage one or more components of the printer/encoder system 160. In other embodiments of the present invention, the user interface 175 may be located in other locations on the printer/encoder system 100. In addition to, or as an alternative to, the user interface 175, a separate user interface may be located apart from the printer/encoder system 100. For example, as described above, FIG. 2 shows an embodiment of the present invention where a separate user interface is located in a passenger accessible area of the mobile unit 50. Such user interfaces may be adapted to drive the printer/encoder system 100 of various embodiments of the present invention as will be apparent to one of ordinary skill in the art.

FIG. 7 is a side view illustrating in dashed lines various components enclosed within the printer/encoder system 100 embodiment depicted in FIGS. 3, 4, 5, and 6. For example, FIG. 7 depicts, in dashed lines, a printer assembly 170, an encoder antenna assembly 180 including an encoder antenna casing 182, an encoder electronics assembly 190, and a media unit supply 138. The depicted antenna casing 182 is enclosed within the antenna housing portion 167 of the shell 165. As described above, the encoder antenna is electrically connected to and driven by the encoder electronics assembly 190. In the depicted embodiment, the encoder electronics assembly 190 is located proximate one end of the housing 125 as shown. In various embodiments, the encoder electronics end of the housing 125 is integral to or attached to the under side of the inverted C-shaped bracket 117 as shown. In this regard, the encoder electronics assembly 190 obtains the benefit of the shock resistance system described above.

In the depicted embodiment, the media supply 138 is stored at a second end of the housing 125 as shown. As noted above, the depicted media supply 138 is provided in a fanfold arrangement merely for illustration purposes and multiple additional media storage configurations may be used.

It may be notable from the embodiment depicted in FIG. 7 that the encoder electronics assembly 190 is located exterior to the printer/encoder shell 165 and connected to the encoder antenna assembly 182 by one or more cables. In this regard, a modular arrangement is provided whereby the type (e.g., UHF, HF, etc), size, and structure of the encoder electronics may be changed depending upon the application. Further, the encoder electronics may be readily serviced or replaced without opening the printer/encoder shell 165 and thereby potentially introducing dirt, moisture, or other print degrading contaminants into the printer system.

FIG. 8 shows the side view of the printer/encoder system as shown in FIG. 7 except that the hinged antenna access panel 168 is shown in the open configuration. This configuration more clearly shows the antenna casing 182 located within the antenna housing 167. FIG. 8 shows an antenna casing 182 configured in a half cylinder-like configuration for fitting into a similar-shaped cavity defined for receiving the antenna casing. In various embodiments of the present invention, the antenna casing 182 is structured to concentrate electromagnetic energy transmitted by the antenna on a given media unit and also potentially shield such electromagnetic energy from other media units. In this regard, the antenna casing may be comprised of metal or other similar surfaces that are structured to limit passage of electromagnetic energy.

In one embodiment, the antenna casing 182 defines a media adjacent surface 183 that is adapted for positioning adjacent a media unit intended for encoding (i.e., reading, writing, etc.). The media adjacent surface may define an interrogation window through which electromagnetic energy may be transmitted. In one embodiment, as will be described in greater detail below with respect to FIGS. 9 and 9A, the interrogation window may receive a protective polymer shield that prevents against ingress of dirt, moisture, and other contaminants while allowing the passage of electromagnetic energy transmitted by the antenna assembly.

FIG. 9 shows the top view of the printer/encoder system as shown in FIG. 8 with the hinged antenna access panel 168 is shown in the open configuration. This configuration more clearly shows the antenna casing 182 located within the antenna housing portion 167. Cable 181, which electrically connects the encoder electronics assembly 190 with the encoder antenna assembly 180, is illustrated connecting to one side of the antenna casing 182 via cable connector 181*a*. As noted above, having the encoder electronic assembly 190 located separate from the encoder antenna assembly 180, and easily detachable from each other and from the printer/encoder system 100, may have the advantage of allowing for easier interchangeability of encoder antennas and/or encoder electronic assemblies. More specifically, in one embodiment, different antenna assemblies, having different antenna types, sizes, and/or configurations, may be replaceably provided for tailoring the antenna structure to a particular size, length, or shape of media unit. Further, such differing antenna structures may be provided to interrogate differing transponder locations on a given media unit. In one embodiment of the present invention, the antenna assembly 180 can be changed without changing the electronic assembly 190 that drives the antenna assembly. In other embodiments, the electrical assembly 190 and the antenna assembly 180 may be able to be serviced individually.

FIG. 9A shows a top view of an exemplary antenna structure 182*a* provided on an antenna assembly housed within an antenna casing in accordance with one embodiment of the present invention. The depicted antenna structure 182*a* may be visible through the interrogation window defined in the media adjacent surface of the antenna casing along Arrow 9A as shown in FIG. 9. The depicted antenna structure 182*a* includes a printed circuit board (PCB) 185 for supporting an input port 187, a conductor 188, and terminating load 189. Each of these components are provided in electrical communication as will be apparent to one of ordinary skill in the art. The input port 187 may be connected to the encoder electronics assembly 190 via the cable 181 and the terminating load 189 may be connected to the encoder electronics assembly 190 via the conductor 188 and the cable 181. The specific design and configuration of the conductor 188 dictates at least some elements of the performance of the antenna. As such, a person skilled in the art may use many different RF antennas (e.g., a half-wavelength transmission line, a microstrip, or a coplanar transmission line coupler) to achieve various embodiments of the present invention. The antenna depicted in FIG. 9A is an antenna in a "bow tie" conductor configuration that allows for increased bandwidth, thereby allowing for antennas having a smaller overall length, which may be advantageous in some embodiments of the present invention. Of course, the antenna assembly embodiments depicted in FIGS. 9 and 9A are for illustration purposes and multiple non-resonant antenna structures may be used.

FIG. 10 is a perspective view of another embodiment of the printer/encoder system 100 of the present invention. The depicted embodiment comprises all of the printer/encoder system components as described above for the other embodiments; however, the media supply assembly 130 in this embodiment is not rigidly attached to the bracket assembly of the printer/encoder system 100. In this embodiment, the media supply assembly may be attached directly to the mobile unit and located remotely from the bracket assembly. This embodiment may, in fact, be preferable in some applications as rigid attachment of the media storage bin to the bracket assembly may provide undue weight or strain on the bracket assembly. The media supply assembly may be mounted in any number of configurations without departing from the inventive concepts of the present invention.

In one embodiment of the present invention, the printer encoder system 100 is adapted to communicate wirelessly or by a wired connection with one or more servers other electronic devices via a communication network. For example, the printer/encoder system 100 may include a wireless transceiver that allows the printer/encoder to communicate information to and/or from an inventory management system via, for example, a wireless local area network (WLAN). The printer/encoder system 100 may be configured to synchronize automatically with the other device or may be configured to communicate with the other device when instructed to do so by a user of the printer/encoder system 100 or by a user of the other device.

In another embodiment of the present invention, the printer/encoder system 100 is adapted to communicate with one or more RF antennas located apart from the printer/encoder system 100, such as an RF antenna located proximate the loading area of the mobile unit 50. For example, the printer/encoder system 100 may be configured to communicate, wirelessly or by a wired connection, with one or more of the RF antennas 330 of the prior art system illustrated in FIG. 1. In this regard, in one embodiment, the mobile unit 50 may have a RF antenna located proximate the loading area for reading information from a RFID tag associated with a pallet of articles in the loading area. The printer/encoder system 100 may be able to communicate with the RF antenna to receive the RFID tag information and may then use this information to print and/or encode one or more media units.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An antenna assembly comprising:

an antenna conductor including at least one of a half-wavelength transmission line coupler, a microstrip coupler, a coplanar transmission line coupler, or a bow-tie antenna coupler;

an input port; and a terminating load, wherein the antenna assembly is configured to:

wirelessly transmit electromagnetic energy to read information from, write information to, or both read and write information to one or more radio frequency transponders in one or more media units;

be detachably coupled to an encoder electronics assembly; and be removable from an antenna housing without the encoder electronics assembly being mechanically detached from the antenna housing.

2. The antenna assembly of claim 1, wherein the antenna assembly is further configured to be detachably coupled to a mobile unit.

3. The antenna assembly of claim 1 further comprising an antenna casing structured to concentrate the electromagnetic energy on a first media unit and prevent electromagnetic coupling with other media units.

4. The antenna assembly of claim 3, wherein the antenna casing comprises:

a first casing surface comprised of an electromagnetic energy blocking material; and an interrogation window in the first casing surface configured to allow the electromagnetic energy to pass therethrough.

5. The antenna assembly of claim 4, wherein the interrogation window is comprised of a second casing surface formed of a material that permits electromagnetic energy to pass therethrough.

6. The antenna assembly of claim 1, wherein the antenna assembly is located proximate the loading area of a forklift.

7. The antenna assembly of claim 1, wherein the antenna assembly is configured to be detachably coupled to the encoder electronics assembly using a cable.

8. The antenna assembly of claim 1, wherein the antenna conductor includes a bow tie conductor.

9. The antenna assembly of claim 1, wherein the antenna assembly is further configured to be detachably coupled to a second encoder electronics assembly, the second encoder electronics assembly being different from the encoder electronics assembly in one or more of type, size and structure.

* * * * *